US005209464A

United States Patent [19]

Bermel et al.

[11] Patent Number: 5,209,464

[45] Date of Patent: May 11, 1993

[54] BOTTOM SCUFF SHEET FEEDER

[75] Inventors: Alexandra D. Bermel, Spencerport; Larry J. Mortellaro, Batavia; Steven M. Russel, Pittsford; Robert H. Shea, Victor, all of N.Y.

[73] Assignee: Eastman Kodak Company, Rochester, N.Y.

[21] Appl. No.: 855,966

[22] Filed: Mar. 23, 1992

[51] Int. Cl.[5] ..... B65H 3/04

[52] U.S. Cl. ..... 271/35; 271/121

[58] Field of Search ..... 271/35, 94, 121, 125

[56] References Cited

U.S. PATENT DOCUMENTS

| | | | |
|---|---|---|---|
| 3,262,697 | 7/1966 | Krinke | 271/35 X |
| 3,934,869 | 1/1976 | Strobel, Jr. | 271/35 |
| 4,059,262 | 11/1971 | Fujimoto | 271/35 |
| 4,418,904 | 12/1983 | Fujimoto | 271/37 |
| 4,579,332 | 4/1986 | Larson | 271/35 |
| 4,591,141 | 5/1986 | Wentzel et al. | 271/127 |
| 4,606,535 | 8/1986 | Larson | 271/10 |
| 4,991,831 | 2/1991 | Green | 271/125 X |
| 5,004,218 | 4/1991 | Sardano et al. | 271/35 |

FOREIGN PATENT DOCUMENTS

| | | | |
|---|---|---|---|
| 181644 | 7/1989 | Japan | 271/35 |
| 1387817 | 3/1975 | United Kingdom | 271/125 |

*Primary Examiner*—Richard A. Schacher
*Attorney, Agent, or Firm*—Lawrence P. Kessler

[57] ABSTRACT

Sheet feed apparatus including a scuff feeder for reliably transporting sheets from the bottom of a stack of sheets without marking of the sheets. The sheet transport apparatus comprises a retard device, located in contact with the lead edge, in the direction of sheet feed, of a sheet stack for preventing double feeding of sheets from the sheet stack. A scuff feed belt is located to have a run extending in the direction of sheet feed substantially above the surface of the tray and below the retard device to form a sheet separation nip with the retard device. The run of the scuff feed belt presents an area of contact with the sheet stack to carry about 50% of the weight of the sheet stack. Additionally, the scuff feed belt of the scuff feeder and the retard device respectively have a plurality of grooves oriented in the direction of sheet feed. The grooves assure adequate sheet feeding contact by the scuff feed belt and the retard device in that the lands of the grooves are far enough apart to penetrate any oil on the sheets and collect the oil in the valleys away from the traction area, yet close enough together to prevent localized high pressure points which would result in toner ruboff.

16 Claims, 2 Drawing Sheets

BOTTOM SCUFF SHEET FEEDER

BACKGROUND OF THE INVENTION

The present invention relates in general to feeders for transporting sheets from a sheet stack, and more particularly, to a scuff feeder for reliabily transporting sheets from the bottom of a stack of sheets without marking of the sheets.

In modern reproduction apparatus, such as electrostatographic copiers or printers, for example, a latent image of information to be reproduced is formed on a uniformly charged dielectric member to altering the charge in an image-wise pattern. The latent image charge pattern is then developed with pigmented marking particles. Thereafter, the developed image is transferred to a receiver member and fixed to the receiver member by application of heat and/or pressure to form the desired reproduction.

In order to improve productivity of reproduction apparatus, certain reproduction apparatus provide sheet feed paths capable of enabling the apparatus to reproduce information on both sides of receiver sheets. This is commonly referred to as duplex copying. Duplex copying may be accomplished in a single pass through the reproduction cycle of a reproduction apparatus (single pass duplexing), or in two passes through the reproduction cycle (double pass duplexing). For single pass duplexing, developed images of appropriate information are transferred respectively to each side of a receiver sheet and then fixed simultaneously to the receiver sheet. On the other than, for double pass duplexing, a sheet feed path is provided having an intermediate tray in which sheets, after having developed images transferred and fixed respectively on one side thereof, are stored and then at a subsequent time fed seriatim from the intermediate tray to have developed images transferred and fixed respectively on the opposite side thereof.

While double pass duplex copying is typically somewhat slower in overall reproduction productivity than single pass duplex copying, double pass duplex copying does simplify handling of receiver sheets during transport to the fixing device. This is due to the fact that only one side of the respective receiver sheets bears an unfixed toner image. However, the use of an intermediate tray in reproduction apparatus for enabling the production of duplex copies does expose the reproduction apparatus to the possibility of encountering several operational problems. Specifically, after the first side reproduction is formed on a sheet, the toned image on the first side may be soft due to insufficient time for the marking particles comprising the toned image to completely cool for fixing of the image to the sheet. This may result in fresh toner rubbing off one sheet onto the next sheet, as the sheets are fed from the intermediate tray, forming undesirable marks on such next sheet. Additionally, it is common practice to use an offset preventing oil (for example, a silicone oil) in the reproduction apparatus fusing mechanism. Some quantity of this offset preventing oil from the fusing mechanism may be deposited on the surfaces of the sheets when the fusing mechanism is used to fix the first side reproductions to the sheets respectively. As a result, the oil may materially alter the coefficient of friction in the mechanism for feeding sheets from the intermediate tray, thereby interfering with reliable feeding of the sheets from the intermediate tray (may result in misfeeds or multifeeds).

SUMMARY OF THE INVENTION

This invention is directed to a sheet feed apparatus including a scuff feeder for reliably transporting sheets from the bottom of a stack of sheets without marking of the sheets. The sheet transport apparatus comprises a retard device, located in contact with the lead edge, in the direction of sheet feed, of a sheet stack for preventing double feeding of sheets from the sheet stack. A scuff feed belt is located to have a run extending in the direction of sheet feed substantially above the surface of the tray and below the retard device to form a sheet separation nip with the retard device. The run of the scuff feed belt presents an area of contact with the sheet stack to carry about 50% of the weight of the sheet stack.

As an additional aspect of this invention, the scuff feed belt of the scuff feeder and the retard device respectively have a plurality of grooves oriented in the direction of sheet feed. The grooves assure adequate sheet feeding contact by the scuff feed belt and the retard device in that the lands of the grooves are far enough apart to penetrate any oil on the sheets and collect the oil in the valleys away from the traction area, yet close enough together to prevent localized high pressure points which would result in toner ruboff. The grooves have a substantially square cross-section such that as wearing occurs, the contact relationship remains relatively constant.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 2:
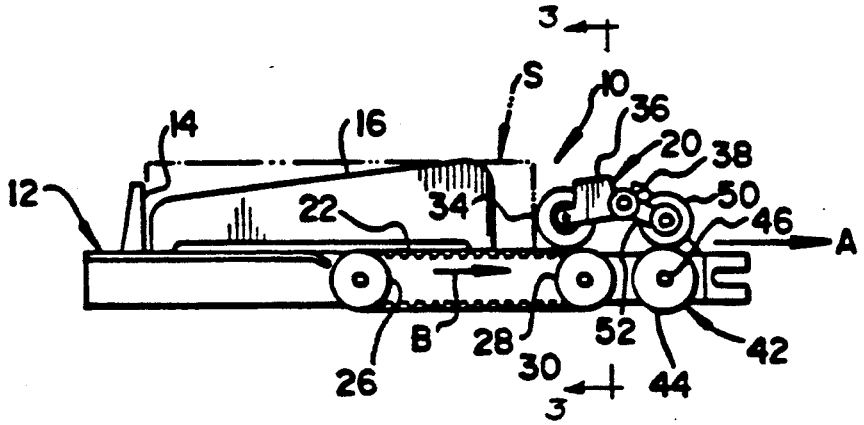
FIG. 2 is a side elevational view, in cross-section, of the bottom scuff sheet feeder of FIG. 1, taken along the lines 2—2 of FIG. 1 with portions removed to facilitate viewing.
Figure 1:
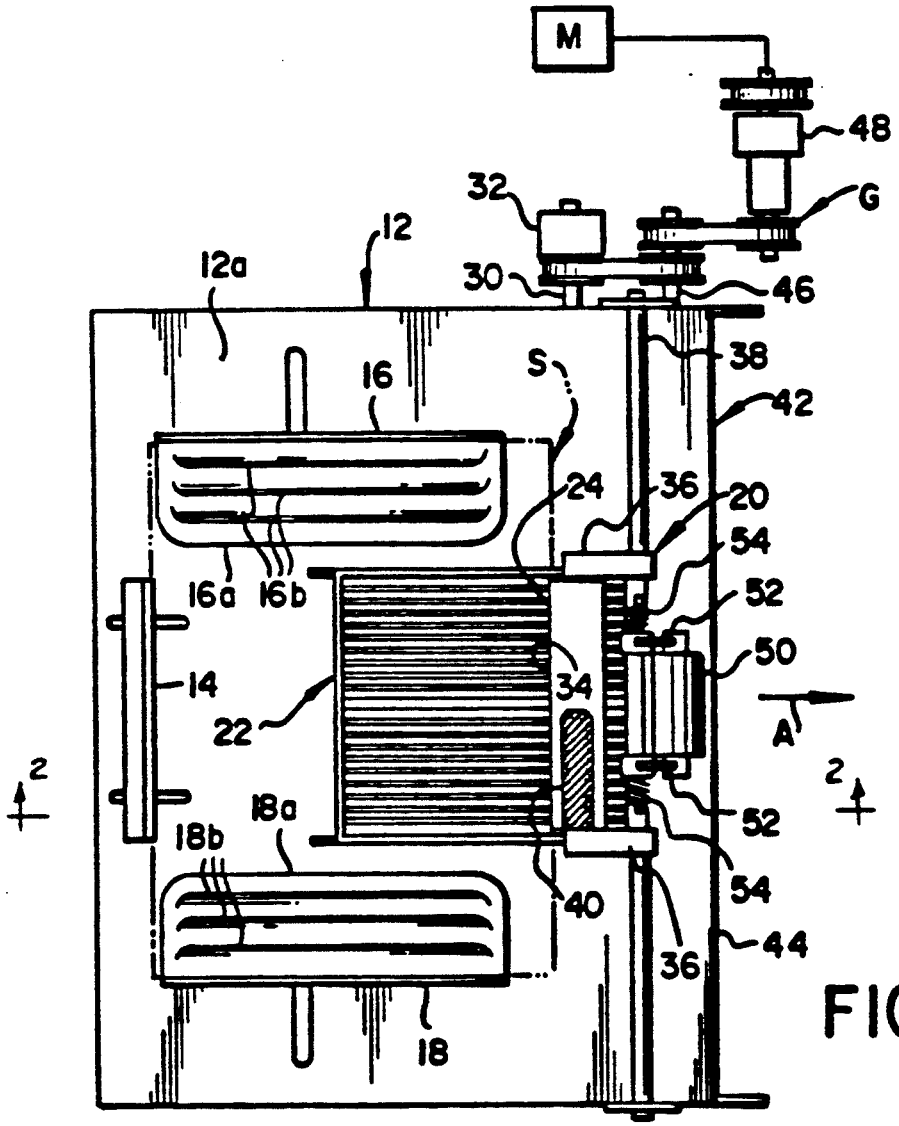
FIG. 1 is a top plan view of the bottom scuff sheet feeder according to this invention.

Referring now to the accompanying drawings, the bottom scuff sheet feeder, according to this invention, is designated generally by the numeral 10. The bottom scuff sheet feeder 10 includes a tray 12 and a scuff feed mechanism 20 associated with the tray for feeding sheets seriatim from the tray in the direction of arrow A. The tray 12 has a substantially planer surface **12*a* upon which a stack of sheets S (shown in phantom lines in FIGS. 1 and 2) may be located. In the instance where the tray 12 serves as an intermediate tray for a reproduction apparatus capable of double pass duplex copying, sheets are fed seriatim to the tray 12 and collected on the surface 12***a* to form the stack S. Of course this invention is also suitable for use where a stack of sheets is manually or automatically loaded onto the surface 12*a*.

The opposed marginal edges of the sheet stack S, in the crosstrack direction relative to the sheet feed direction, are bounded by side guides 16, and 18. The rear marginal edge of the sheet stack is bounded by an end guide 14. The side guides 16, 18 and the end guide 14 are adjustable, in any well known manner, in order to accommodate sheet stacks of various dimensions. Adjustably setting the location of the side guides and end guide maintains the respective loaded sheet stacks in a desired position on the surface 12*a* of the tray 12 relative to the scuff feed mechanism 20.

The scuff feed mechanism 20 is generally of the type described in U.S. Pat. No. 5,007,627, issued Apr. 16, 1991, in the names of Giannetti et al. The Giannetti et al patent can be referred to for a detailed description of the basic scuff feed mechanism and its operation. Such scuff feed mechanism is discussed hereinbelow in sufficient detail for a full understanding of the advantageous modifications to the basic scuff feed mechanism provided by this invention.

Specifically, the scuff feed mechanism 20 includes a scuff feed belt 22 and a retard device 24. The scuff feed belt 22 is drivingly entrained about rollers 26, 28 located to establish a run for the scuff feed belt positioned above the level of the surface 12*a* of the tray 12 (see FIGS. 2 and 3) to substantially support the sheet stack S in a manner discussed below. Roller 28 is mounted on a shaft 30 coupled through a clutch 32 (and a pulley and belt arrangement G) to a motor M for selective rotation of the shaft. When it is desired to feed a sheet from the stack S, the scuff feed belt 22 is driven in the direction of arrow B, about the closed loop path defined by the rollers 26 and 28, by energizing the clutch 32 to connect the shaft 30 to the motor M.

The retard device 24, for preventing multisheet feeds, includes a retard roller 34 supported by arms 36. The arms 36 are, in turn, supported for pivotable movement about a shaft 38 located downstream, in the direction of sheet travel, of the retard roller 34 and above the plane of the surface 12*a* of the tray 12. The retard roller 34, which normally rests on the scuff feed belt 22, engages the lead marginal edge of the sheet stack S and forms a separation nip with the scuff feed belt. An internal brake 40, associated with the retard roller 34, prevents rotation of the retard roller when one or more sheets enter the nip between the retard roller and the scuff feed belt 22, but permits rotation of the retard roller when no sheets are in such nip. This keeps the main body of the sheet stack out of the nip itself. As a result, sheet-to-sheet contact in the nip and under the pressure exhibited therein is avoided. Pressure between the sheets, as further discussed below, is a prime contributor to toner ruboff.

Figure 4:
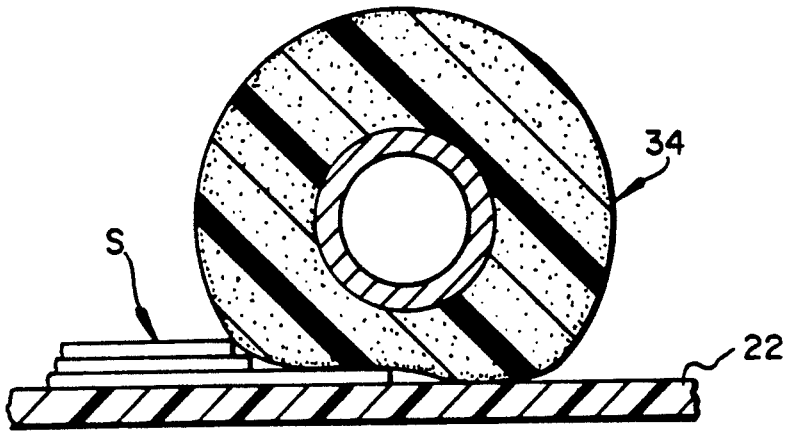
FIG. 4 is a side elevational view, on an enlarged scale, of the transport nip of the bottom scuff sheet feeder of FIG. 1.

As a more detailed explanation of how the internal brake functions to aid the retard roller 34 in preventing multisheet feeds, it is noted that the coefficients of friction of both the scuff feed belt 22 and the retard roller 34 are selected to be quite high when compared to the coefficients of friction of sheets being fed. The braking force of the internal brake 40 on the retard roller 34 is selected to be sufficiently high enough to keep the retard roller from rotating when the bottom sheet, under the urging of the scuff feed belt 22, slides on the next adjacent sheet through the separation nip between the retard roller and the scuff feed belt. Accordingly, such next adjacent sheet remains stationary in the entrance to the separation nip as the bottom sheet is separated from the sheet stack S (see FIG. 4). That is, such next adjacent sheet is held further back in relation to the sheet stack and less under the retard roller 34 than with previously known scuff feeders. At the time between sheet feeds when the bottom sheet has left the separation nip or when the last sheet in the stack has been fed, the friction urging force on the retard roller 34 by the scuff feed belt 22 is substantially increased over that exerted with a sheet between the scuff feed belt and the retard roller. Under such condition, the internal brake 40 has insufficient braking force to prevent the retard roller from rotating, and thus the retard roller will be rotated by the frictional engagement with the scuff feed belt. This has the effect of bringing the next sheet to be fed from the stack into the separation nip. Such frictionally induced rotation has a further benefit in that it prevents undue wear and tear on the scuff feed belt and retard roller that would otherwise occur due to relative movement between the retard roller and the scuff feed belt when no sheet is present in the separation nip therebetween.

A sheet transport device 42 is located immediately downstream, in the direction of sheet feed, from the separation nip formed by the scuff feed belt 22 and the retard roller 34. The sheet transport device 42 includes a drive roller 44 mounted on a shaft 46. The shaft 46 is coupled through a clutch 48, and the pulley and belt arrangement G, to a motor (for example, motor M). Selective activation of the clutch 48 provides for rotation of the shaft, and thus selective rotation of the drive roller 44. A roller 50 is supported by arms 52, which are in turn supported for pivotable movement about the shaft 38. Spring members 54 urge the arms 52 in a direction (clockwise in FIG. 1) such that the roller 50 forms a feed nip with the roller 44.

The purpose of the feed nip between the roller 50 and the drive roller 44 is to effect transport of a sheet removed from the sheet stack S by the scuff feed belt 22 away from the tray 12 in the direction of arrow A. That is, when a sheet is removed from the stack S by the scuff feed belt 22 and forwarded to the feed nip, the clutch 48 is activated to cause the drive roller 44 to rotate and transport the sheet away from the tray 12. The surface velocity of the drive roller 44 is selected to be slightly greater than the surface velocity of the scuff feed belt 22. As such, a separated sheet is sped up on entering the nip between the drive roller 44 and the roller 50. This assures removal of the sheet from the separation nip between the scuff feed belt 22 and the retard roller 34, thereby further preventing any misfeeds (multifeeds) of sheets from the stack S in the tray 12.

As noted above, previous scuff sheet feeders have suffered from two major problems: misfeeds (multifeeds) due to, for example, fuser oil on the individual sheets; and marking of adjacent sheets due to toner ruboff. As will be readily appreciated, when considering remedies to these problems, one is led to opposite suggestions for each of the respective problems. That is to say, to prevent misfeeds (multifeeds) due to the reduction in friction caused by oil on the sheets, technology would suggest that the pressure in the sheet separation nip should be increased. However, an increase in the sheet separation nip pressure would increase the possibility that soft toner will be rubbed off, thus accentuating the marking problem. Of course, reducing the sheet separation nip pressure to relieve the toner ruboff marking problem would increase the potential for misfeeds (multifeeds).

Figure 3:
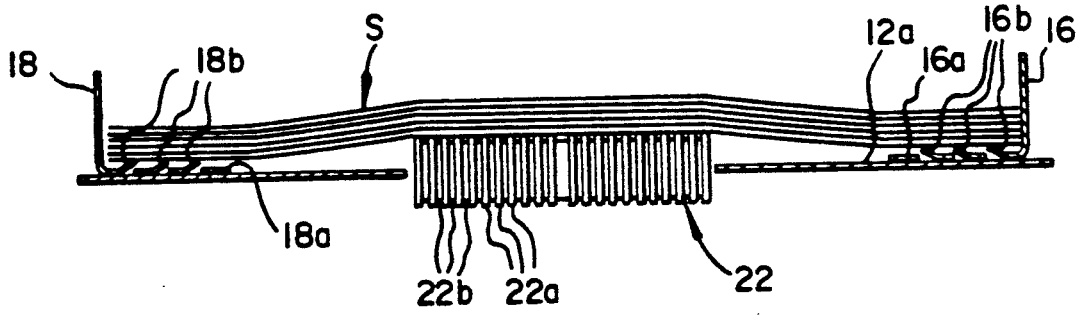
FIG. 3 is an end elevational view, in cross-section, of the bottom scuff sheet feeder of FIG. 1 taken along the lines 3—3 of FIG. 2.

The sheet feeder 10 according to this invention solves both the misfeeding and toner ruboff marking problems by markedly reducing the pressure in the sheet separation nip while substantially extending the area over which the sheet separation nip pressure is applied. Specifically, the scuff feed belt 22 is arranged such that the upper run thereof supports about 50% of the weight of the sheet stack S in the tray 12. As shown in FIG. 3, the scuff feed belt 22, which is much wider than those of prior known scuff feed belts, extends in the direction cross-track to the sheet feed direction A over a distance to support the major portion of the sheet (at least 30% of the cross-track sheet dimension). Further, the portions 16*a*, 18*a* of the side guides 16, 18 have upstanding louver-like segments 16*b*, 18*b* respectively to present less surface area contact with that portion of the sheet stack supported on such portions of the side guides. Since any oil on the sheets would tend to cause the sheets to stick to a flat supporting surface, the louver-like arrangement reduces the frictional engagement area between the side guide portions 16*a*, 18*a* and the sheets, and thus reduces the friction forces acting in opposition to feeding of the sheets from the stack.

This described arrangement substantially increases the effective traction surface area for scuff feeding of the sheets from the sheet stack by the scuff feed belt 22 and decreases the contact area supporting the sheet stack in the tray 12. Accordingly, the forces effecting sheet separation are distributed over a substantially increased area, reducing the force per unit area on any sheet; and the friction force exerted on the sheet by the tray surface 12*a*, retarding sheet separation, is reduced. While the total force to effect separation is at least as great as heretofore provided, the actual pressure at any point is substantially reduced (such pressure reduction is on the order of a factor of 50 from previously known scuff feeders). This substantially reduces any potential to rub off toner from one sheet to an adjacent sheet.

Figure 5:
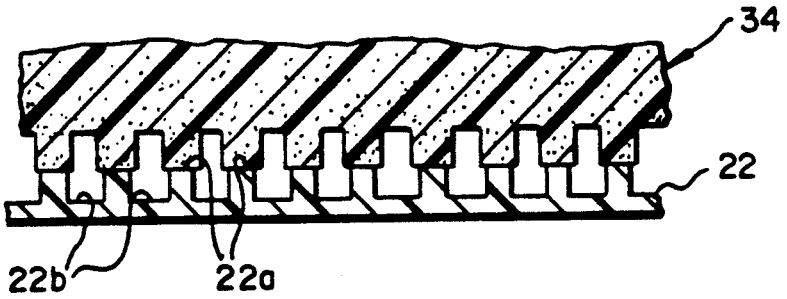
FIG. 5 is an end elevational view, on an enlarged scale, of the transport nip of the bottom scuff sheet feeder of FIG. 1, showing the groove arrangement.

It should also be noted that the sheet engaging outer surface of the scuff feed belt 22 is formed of a material having a high coefficient of friction, and is grooved to maintain effective traction contact with the sheet being fed in the sheet separation nip. The grooved configuration of the scuff feed belt provides small lands 22*a*, which are effective in penetrating any oil on the sheet, and valleys 22*b*, which establish a reservoir in which the oil may collect (see FIG. 5). The lands, oriented in the intrack direction, optimally make up approximately 30% of the scuff feed belt area. The grooves are of a generally square cross-section configuration. This is important in that, with such configuration, wearing of the scuff feed belt over time does not appreciably alter the optimum surface area contact between the scuff feed belt and the sheets being fed. The grooves are spaced far enough apart such that the lands 22*a* penetrate any oil on the sheets and the oil collects in the valleys 22*b* away from the traction area, yet close enough together to prevent localized high pressure points which would result in toner ruboff. With such grooved configuration for the scuff feed belt 22, the potentially adverse feeding effect of oil on the sheets to be fed by the scuff feed belt is substantially overcome.

Another way in which the sheet separation nip pressure is substantially reduced, involves the arrangement of the retard roller 34. The retard roller 34 is of a larger diameter and an increased longitudinal dimension when compared to retard rollers heretofore utilized (such as, for example, in the aforementioned U.S. Pat. No. 5,007,627). Additionally, the retard roller is formed of a substantially rigid hollow core 34*a* with a high coefficient of friction overcoat of soft foam 34*b* sufficient to yield about a 20% radial deflection for the retard roller (see FIG. 4). The core 34*a* has a relationship to the retard roller such that its diameter is approximately 50% of the overall retard roller diameter. As a result of the radial deflection of the retard roller, the sheet separation nip area established by engagement of the retard roller 34 with the scuff feed belt 22 is about 50 times greater than previously provided. At the same time, the rigid hollow core 34*a* prevents any substantial tangential deflection of the retard roller which might allow a subsequent sheet to be prematurely fed into the separation nip between the retard roller and the scuff feed belt.

As with the scuff feed belt 22, the retard roller 34 has a groove pattern to provide adequate sheet contact (i.e., penetrate any oil on the sheet and collect the oil away from the traction area, and prevent localized high pressure points, as described above). It is important to realize that the groves in the retard roller 34 should not interlock with the grooves in the scuff feed belt 22 (see FIG. 5). This is because, as previously described, the scuff feed belt is used to rotate the retard roller between sheet feeds (i.e., overcome the action of the internal brake 40) to prevent wear therebetween. Therefore, there must be sufficient contact between the lands of the grooves of the scuff feed belt 22 and the lands of the grooves of the retard roller 34 for the belt to rotate the roller to pull the next sheet into the separation nip.

The material forming the retard roller 34 must also exhibit a high tear strength and a high elasticity rating to overcome the fact that the retard roller is continually being rubbed by sharp edges of the sheets being fed. Further, the retard roller material must be stable in the harsh environment of the reproduction apparatus, such as elevated temperatures and the presence of fuser (silicone) oil and ozone.

The pivot angle of the arms 36 supporting the retard roller 34 are set to approximately $28° \pm 5°$ from the horizontal. The increased pivot angle, over prior scuff feeders, results in an increased normal force in the sheet separation nip at the start of sheet separation, and a reduced normal force in the nip as the separated sheet moves out of the sheet stack. This reduces the average sheet-to-sheet pressure and thus the tendency for marking (toner rub off between adjacent sheets). Additionally, as discussed above, the retard roller internal brake 40 has a relatively high braking force. This holds a second sheet further back in relation to the sheet stack and less under the retard roller 34. This further assures a reduced sheet-to-sheet pressure, and likewise reduced tendency for marking due to toner ruboff.

The invention has been described in detail with particular reference to preferred embodiments thereof, but it will be understood that variations and modifications can be effected within the spirit and scope of the invention as set forth in the claims.

What is claimed is:

1. Apparatus for transporting sheets seriatim from a stack located on the surface of a tray, said apparatus comprising:

retard means, located in contact with the lead edge, in the direction of sheet feed, of a sheet stack, for preventing double feeding of sheets from said sheet stack; and a scuff feed belt having a plurality of grooves oriented in the direction of sheet feed, said scuff feed belt located to have a run extending in the direction of sheet feed substantially above the surface of said tray and below said retard means to form a sheet separation nip with said retard means, said run of said belt presenting an area of contact with said sheet stack to carry about 50% of the weight of said sheet stack.

2. The sheet transport apparatus according to claim 1 wherein said grooves are of a substantially square cross-sectional configuration.

3. The sheet transport apparatus according to claim 2 wherein said grooves provide a series of lands and valleys, said lands constituting approximately 30% of the surface area of said scuff feed belt.

4. The sheet transport apparatus according to claim 1 wherein said retard means includes a roller elongated in the direction cross-track to the direction of sheet feed, and wherein said scuff feed belt is at least as wide as said roller is long to distribute forces of sheet separation over a substantial extended area.

5. The sheet transport apparatus according to claim 4 wherein said roller extends for at least 25% of the cross-track dimension of the sheets.

6. The sheet transport apparatus according to claim 5 wherein said roller is formed of a material sufficiently compliant to provide for about a 20% deflection in the radial direction.

7. The sheet transport apparatus according to claim 6 wherein said roller includes a substantially rigid core supporting said compliant material.

8. The sheet transport apparatus according to claim 7 wherein said core is of a diameter equal to about 50% of the overall diameter of said roller such that tangential deflection of said roller is substantially prevented.

9. The sheet transport apparatus according to claim 4 wherein said roller of said retard means has a plurality of grooves oriented in the direction of sheet feed.

10. The sheet transport apparatus according to claim 4 wherein said scuff feed belt has a plurality of grooves oriented in the direction of sheet feed, and wherein said roller of said retard means has a plurality of grooves oriented in the direction of sheet feed.

11. The sheet transport apparatus according to claim 10 wherein said grooves of said scuff feed belt and said grooves of said roller of said retard means are located so as not to interlock.

12. Apparatus for transporting sheets seriatim from a stack, said sheet transport apparatus comprising:

a tray having a sheet stack supporting surface;

a scuff feed belt, located to have a run extending in the direction of sheet feed substantially above said sheet stack supporting surface of said tray, said run of said belt presenting an area of contact with said sheet stack to carry about 50% of the weight of said sheet stack;

a retard roller, elongated in the direction cross-track to the direction of sheet feed, in operative association with said scuff feed belt to form a sheet separation nip therebetween, said scuff feed belt being at least as wide as said retard roller is long to distribute forces of sheet separation over a substantial extended area, said retard roller having an internal brake for preventing rotation of said retard roller when a sheet is in said separation nip between said retard roller and said scuff feed belt for preventing double feeding of sheets from said sheet stack, and allowing said retard roller to rotate when said scuff feed belt directly contact said retard roller without a sheet in the separation nip so as to prevent any substantial wear of said retard roller or said scuff feed belt; and said scuff feed belt and said retard roller respectively having a plurality of grooves oriented in the direction of sheet feed, said grooves of said scuff feed belt and said grooves of said retard roller being located so as not to interlock.

13. The sheet transport apparatus according to claim 12 wherein said retard roller includes a substantially rigid core supporting a material sufficiently compliant to provide for about a 20% deflection in the radial direction.

14. The sheet transport apparatus according to claim 13 wherein said core is of a diameter equal to about 50% of the overall diameter of said retard roller such that tangential deflection of said retard roller is substantially prevented.

15. The sheet transport apparatus according to claim 12 wherein said grooves are of a substantially square cross-sectional configuration providing a series of lands and valleys.

16. The sheet transport apparatus according to claim 15 wherein in said grooves of said scuff feed belt, said lands constitute approximately 30% of the surface area of said scuff feed belt.

* * * * *